US005890285A

United States Patent [19]

Pruitt et al.

[11] Patent Number: 5,890,285

[45] Date of Patent: Apr. 6, 1999

[54] METHOD FOR SUPERPLASTICALLY FORMING A STRUCTURAL ARTICLE

[75] Inventors: Mark O. Pruitt, Florissant; Christopher A. Ross, University City, both of Mo.

[73] Assignee: McDonnell Douglas Corporation, St. Louis, Mo.

[21] Appl. No.: 702,288

[22] Filed: Aug. 23, 1996

[51] Int. Cl.[6] ..... B23P 15/00

[52] U.S. Cl. ..... 29/889.72; 29/897.2; 29/897.3

[58] Field of Search ..... 29/889.72, 889.722, 29/897.2, 463, 897.3, 897.312; 228/157

[56] References Cited

U.S. PATENT DOCUMENTS

| | | | |
|---|---|---|---|
| 3,002,265 | 10/1961 | Stalker | 29/156.8 |
| 3,045,327 | 7/1962 | Clarke et al. | 29/156.8 |
| 3,045,957 | 7/1962 | Clarke et al. | 253/77 |
| 3,052,961 | 9/1962 | Sherman | 29/156.8 |
| 3,058,202 | 10/1962 | Stalker | 29/156.8 |
| 3,135,486 | 6/1964 | Wing | 244/123 |
| 4,642,863 | 2/1987 | Schulz | 29/156.8 B |
| 4,643,646 | 2/1987 | Hahn et al. | 416/226 |
| 5,063,662 | 11/1991 | Porter et al. | 29/889.72 |
| 5,083,371 | 1/1992 | Leibfried et al. | 29/889.72 |
| 5,139,887 | 8/1992 | Sutton | 428/586 |
| 5,243,758 | 9/1993 | LeMonds et al. | 29/889.72 |
| 5,253,419 | 10/1993 | Collot et al. | 29/889.72 |
| 5,269,058 | 12/1993 | Wiggs et al. | 29/889.72 |
| 5,275,325 | 1/1994 | Stracquadaini | 228/44.3 |
| 5,285,573 | 2/1994 | LeMonds et al. | 29/889.72 |
| 5,330,092 | 7/1994 | Gregg et al. | 228/157 |
| 5,384,959 | 1/1995 | Velicki | 29/889.72 |
| 5,448,829 | 9/1995 | Dillner et al. | 29/889.722 |
| 5,457,884 | 10/1995 | Fowler et al. | 39/889.72 |
| 5,581,882 | 12/1996 | Fowler et al. | 29/889.72 |

*Primary Examiner*—I. Cuda
*Attorney, Agent, or Firm*—Bryan Cave LLP

[57] ABSTRACT

A method for forming a hollow structure having a predetermined shape from a sheet of superplastic material. The sheet is initially formed into a preform configuration. A reusable fluid inlet tube is placed in the preform configuration to define a port in fluid communication with the interior portion of the preform configuration. The preform configuration is disposed in a containment die, which defines a cavity having the predetermined desired shape. Force is applied to the containment die to temporarily seal the edges of the preform configuration without the use of welding or diffusion bonding. Once its edges are sealed, the preform configuration becomes a gas-tight envelope capable of holding fluid that is introduced through the fluid inlet tube. Fluid (e.g., argon) is fed through the tube to apply internal pressure to the gas-tight preform configuration under superplastic conditions (including appropriate heating) while it is still being held in the containment die so that it superplastically expands in the die cavity (deforms) into a hollow structure having the predetermined shape. The hollow structure may be an aeronautical member, e.g., an airfoil, or a member used in automobiles, furniture, boats, buildings, railroad cars, hospital equipment, architectural panels, or any other application requiring a closed metal shape.

38 Claims, 4 Drawing Sheets

METHOD FOR SUPERPLASTICALLY FORMING A STRUCTURAL ARTICLE

FIELD OF THE INVENTION

The present invention relates generally to hollow structures and associated methods for forming such structures and, more particularly, to methods for superplastically forming hollow structures from a sheet, and, most particularly, to methods for superplastically forming hollow structures from a single sheet.

BACKGROUND OF THE INVENTION

It has long been desired to fabricate various airframe components, such as canards, winglets, or wings, as hollow bodies. The benefits of using hollow bodies for these airframe components include a substantial reduction in weight, which results in improved fuel efficiency and increased performance.

In a number of applications, an airframe component, such as the leading edge or wing tip of an aircraft's wing, is required to have a shape that would, if made using conventional fabrication techniques, require multiple part fabrication and assembly procedures. For example, one such airfoil structure typically used as a component in the manufacture of aircraft wings is a hollow airfoil shell having a complex, curved leading edge and an open trailing section. This airfoil structure is conventionally fabricated from several parts, which are assembled, joined together with a wing tip section and a trailing edge section, and then partially inserted into and attached to the aircraft fuselage to form the aircraft wing.

Conventionally, these hollow airfoil structures have been constructed using a systematic build-up of multiple subcomponent assemblies. The individual sheet assemblies have comprised a mixture of product forms. These forms included, for example, extruded, forged, cast, or formed sheet, which were then mechanically fastened and tied to the other subcomponent assemblies to fabricate the airfoil structure. At the part level, individual parts required processing through the fabrication stage, then fastened with mating structures during the assembly stage of the manufacturing operation.

With the introduction of new material systems in airframe design, efficient methods to fabricate and integrate subassemblies made from different materials, such as metallic, non-metallic, and matrix elements, have become increasingly important, for example, for improving the weight, cost, and life expectancy of the resultant aircraft structure. A continuing desire of those skilled in the art is to develop structures and methods for forming such structures to significantly reduce the total number of structures and steps required for the final assembly.

Many of the methods developed to manufacture hollow airfoil structures utilize superplastic forming ("SPF") techniques, which techniques rely on the capability of certain materials, such as titanium alloys, to develop unusually high tensile elongation with a minimal tendency towards necking when subjected to coordinated time-temperature-strain conditions within a limited range. This characteristic has been known in the art and used in producing of a wide variety of strong, lightweight metallic structures.

One prior art method involves forming a closed cellular structure from two or more separate layers of sheet material. The two or more layers are joined along respective edge portions (e.g., by welding or diffusion bonding) to form an inflatable envelope assembly. This inflatable assembly is then superplastically formed to produce an integral structural part having a predetermined shape.

It is known to insert one or more inlet tubes between the sheets that comprise an envelope assembly to supply gas under pressure to the interior of the envelope assembly to form the assembly into the desired shape using superplastic forming. The gas supply tube is first positioned and the envelope assembly is then sealed around its periphery to form a gas-tight structure. This sealing typically requires labor intensive and expensive methods, such as seam welding, partial penetration welding, or diffusion bonding using heat and pressure.

It is also known to form an airfoil using a single sheet. The single sheet is formed into a folded over sandwich structure and sealed along its periphery by a continuous weld to form an expandable envelope. This envelope structure is placed in a limiting structure, such as a containment die, and a gas is injected into the interior portion of the envelope structure under superplastic conditions to form or expand the single sheet. Such expansion may occur in two opposing directions. Thus, by applying appropriate internal pressure and temperature to the envelope structure, the envelope may be expanded into the surrounding die configuration, thereby producing the desired structural part.

These prior art techniques suffer from significant disadvantages in addition to those previously mentioned. For example, they require welding or diffusion bonding the periphery of the sheet assembly prior to superplastic forming and then cutting off the welded areas around the periphery of the expanded assembly to form the shell structure. Such removal is labor intensive and inefficient. The welded seam must be removed so that one or more internal members (e.g., internal reinforcing members) can be easily put into position. For example, if the welded seam is not removed from, e.g., the trailing edge, it will be impossible to spread the two major faces of the expanded assembly apart sufficiently to allow an internal member to be positioned.

Additionally, with prior art techniques there is a risk that the one or more inlet tubes that are positioned to supply the gas to the interior of the expandable envelope or sheet assembly will be pinched closed and rendered inoperable while welding the sandwich assembly. The inlet tubes are typically discarded after each use, which increases costs.

Accordingly, there is a continuing need for a method that can be used to create large structural components with reduced manufacturing and assembly costs, reduced part count (i.e., fewer parts), and reduced fasteners, which method results in a structural component having a less complex overall structure. Such a method could desirably use a single sheet that is superplastically formed in two opposing directions, without the need to weld or diffusion bond the edges of the sheet together. Desirably, in making an airfoil structure, such a method would eliminate the need to weld leading and/or trailing edge structures or on aerodynamic centerlines, thus resulting in an airfoil structure having a continuous leading edge. The elimination of welding or diffusion bonding would also enable the method to work with a wider variety of materials, such as aluminum. It would also be desirable to be able to form structures from a sheet without the special preparation of the sheet that is now needed to allow the sheet to accept and hold the gas inlet tubes.

SUMMARY OF THE INVENTION

In accordance with the present invention, a hollow structure (e.g., an airfoil structure) may be fabricated from a single sheet. The single sheet is formed into an initial preform configuration so that the preform configuration has an upper and a lower face. The preform configuration is disposed in a containment die, which defines a cavity having the desired final shape. Force is applied to the containment die so that the edge of the upper face of the preform configuration is held in a sufficiently fixed relationship to the edge of the lower face of the preform configuration to form a gas-tight packet assembly that eliminates the need for the separate prior art step of welding the edges of the packet together. The pressure inside the packet assembly is made higher than the pressure inside the die but outside of the packet assembly (e.g., by raising the internal pressure in the packet assembly) under superplastic conditions so that the packet assembly is superplastically expanded in the die cavity and formed into a hollow structure having the desired final shape.

The present invention further provides a method of introducing a forming gas medium into the packet assembly to superplastically form the preform configuration, without welding together the edges of the preform configuration. According to one embodiment, this method includes the step of placing a reusable inlet tube between the upper and lower face of the preform configuration to define a gas entry port in the packet assembly in fluid communication with the interior portion thereof. Standard superplastic forming temperature and strain rates are used while heating the packet assembly and pressurizing the packet by injecting the fluid into the packet to superplastically expand the packet to fill the die and form the packet into the predetermined shape.

The containment die used in the method of the present invention desirably includes features to enhance its performance and usefulness. For example, the containment die may have a lock and seal groove to maintain consistent die closure and form a gas-tight seal. The edges of the upper and lower faces may be forced into the groove by the closing of the die to help maintain the two faces in the desired fixed relationship to form the gas-tight packet assembly. The containment die may also have a recess to accept and retain the reusable gas inlet tube in the proper position.

The present invention also provides a reusable gas inlet tube designed to provide a means for transporting forming gas into the interior of the preform configuration to permit the preform configuration to be superplastically formed. The reusable gas inlet tube includes a retaining or restraining ring designed to cooperate with the one or more recesses of the containment die to hold the gas inlet tube in place during the superplastic forming step. The reusable gas inlet tube desirably has sealing lands designed to deform the preform configuration upon closure of the containment die to ensure a gas-tight seal between the containment die, the preform configuration, and the gas inlet tube.

In another aspect, the present invention also provides a method of forming a hollow structural component that comprises an external skin and an internal core bonded to the interior of the external skin. Both the external skin and the internal core may be formed from a single sheet. The external skin and internal core may be simultaneously formed in a single containment die having separate cavities for the skin and core.

This method comprises forming two initial preform configurations, each having an upper and a lower face, and placing both configurations in a containment die. The containment die has two cavities, permitting simultaneous forming of the skin assembly and the core assembly. A reusable inlet tube, having a restraining ring and sealing lands, is inserted between the upper and lower face of each preform configuration to define a port in fluid communication with the interior of each configuration. Force is applied to the containment die to sandwich each reusable inlet tube between the upper and lower faces of each preform configuration and form an external skin packet assembly and an internal core packet assembly. Internal fluid pressure is applied to the packet assemblies through the reusable inlet tubes along with heating so that the skin packet assembly and the core packet assembly superplastically deform into a skin assembly and a core assembly respectively by expanding to fill their respective die cavities. After finishing the assemblies, the airfoil structure is formed by inserting the core assembly into the skin assembly and attaching the assemblies together. This aspect of the present invention provides the ability to create an entire airfoil structure, including a skin and a reinforced internal core structure, from two sheets of starting material using only one die forming step.

Yet another aspect of the present invention provides an apparatus for superplastically forming an airfoil structure without separately welding the periphery of the structure prior to or during forming. This apparatus includes a containment die capable of receiving a preformed configuration formed from a single sheet. The containment die has an upper and a lower section, each adapted to be brought together under pressure to form a packet assembly from the preform configuration. The containment die has a recess in at least one section for a reusable fluid inlet tube and a lock bead and seal groove to maintain a gas-tight seal. The apparatus also includes the reusable gas inlet tube, which is inserted into the recess of the containment die and which is capable of maintaining the inside of the packet assembly in fluid communication with a source of pressurized fluid.

BRIEF DESCRIPTION OF THE DRAWINGS

To facilitate further discussion of the invention, the following drawings are provided in which.

These drawings are for illustrative purposes only and should not be used to unduly limit the scope of the claims.

DETAILED DESCRIPTION OF THE INVENTION

Figure 1:
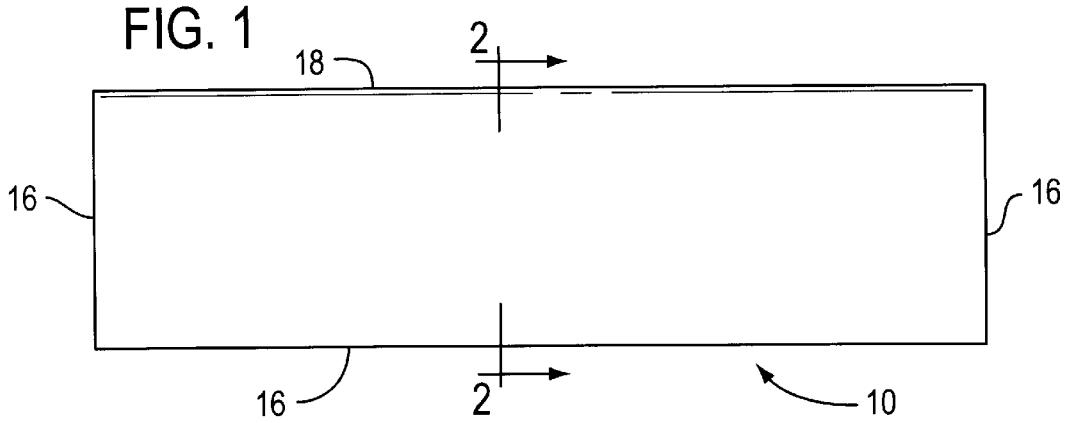
FIG. 1 is a plan view of a single sheet that has been formed into an initial preform configuration.
Figure 2:
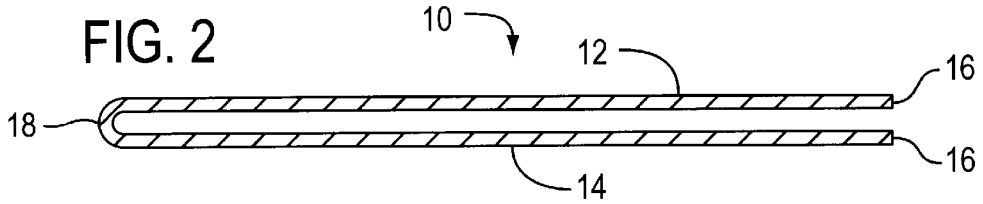
FIG. 2 is a cross-sectional view of the preform configuration of FIG. 1, taken along line 2—2 of FIG. 1.

FIGS. 1 and 2 show a single sheet that has been folded over on itself and is to be used in the method of this invention to fabricate a hollow airfoil structure. The single sheet has superplastic properties, that is, the sheet material exhibits the characteristic of unusually high tensile elongation with minimum necking when deformed within a limited temperature range and strain rate range. As is known to those skilled in the art, a number of materials demonstrate superplastic properties, such as titanium, titanium alloys, aluminum, stainless steel, thermoplastics, and metal matrix composites. This invention is useful with all superplastic materials, alone or in combination (e.g., with superposed sheets of the same or different superplastic materials). The superplastic temperature range varies depending upon the specific material used. For example, titanium alloys generally exhibit superplastic properties at temperatures between about 1500° F. (815° C.) and about 1800° F. (982° C.). Aluminum generally exhibits superplastic properties for temperatures between about 800° F. (427° C.) and about 1000° F. (538° C.). The preferred strain rate also varies depending upon the specific material used.

The single sheet is formed into an initial preform configuration 10, which is shaped to ensure that the final hollow airfoil structure has the desired shape and thickness after the superplastic forming step. The single sheet is formed from a planar configuration into its initial preform configuration using conventional methods such as roll forming or brake forming. The sheet will typically be from 0.020 to 0.200 inches in thickness and from 6"×12" to 48"×96" in size prior to forming.

The preform configuration will usually be in the shape of a shell having a smooth, continuous leading edge and an open, unattached trailing section. The preform configuration 10 has an upper face 12 and a lower face 14, each having edge portions 16. Reference numeral 18 indicates the leading folded edge where upper face 12 and lower face 14 are joined. The edge portion of a face consists of all of the peripheral edges of the face other than the folded edge (e.g., other than folded edge 18). Thus, for a rectangular sheet folded in half lengthwise, the edge portion would consist of the three edges that are not the folded edge.

Figure 3:
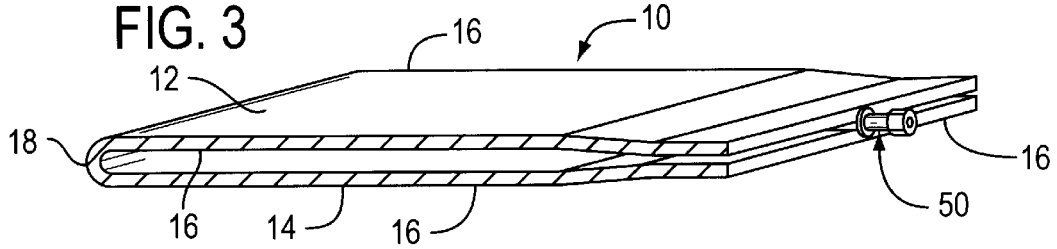
FIG. 3 shows the reusable gas inlet tube inserted into the preform configuration.

Referring to FIG. 3, a means is provided for directing forming gases into the interior of the preform configuration 10. This means includes a gas inlet tube 50, part of which is disposed between the upper face 12 and lower face 14 of the preform configuration 10 to provide fluid communication between the source of pressurized gas (not shown) and the interior of the preform configuration 10. Gas pressure is applied to the interior of the preform configuration 10 during the superplastic forming step.

Figure 4:
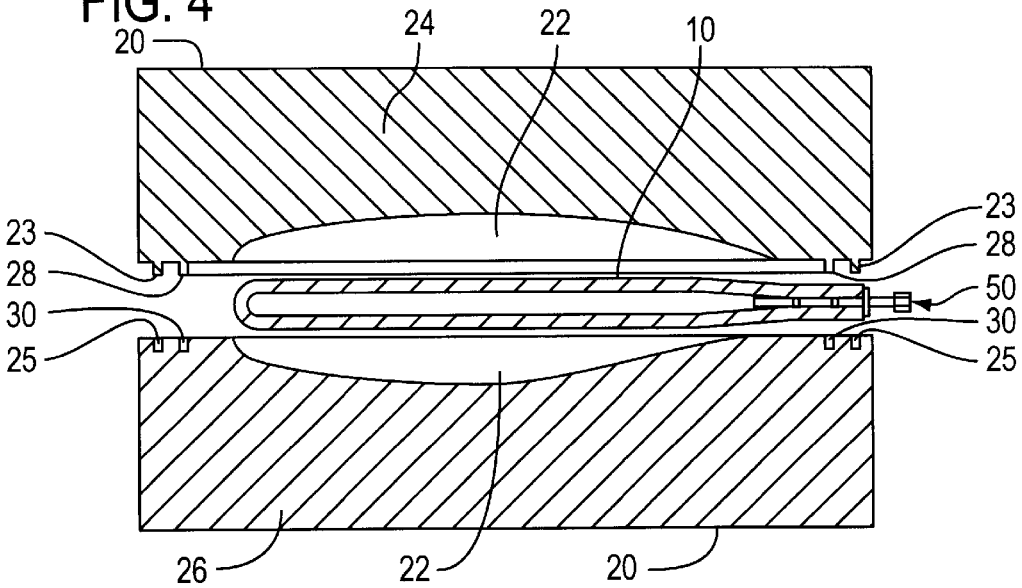
FIG. 4 is a cross-sectional view showing the preform configuration located in a containment die prior to closing the die completely.
Figure 5:
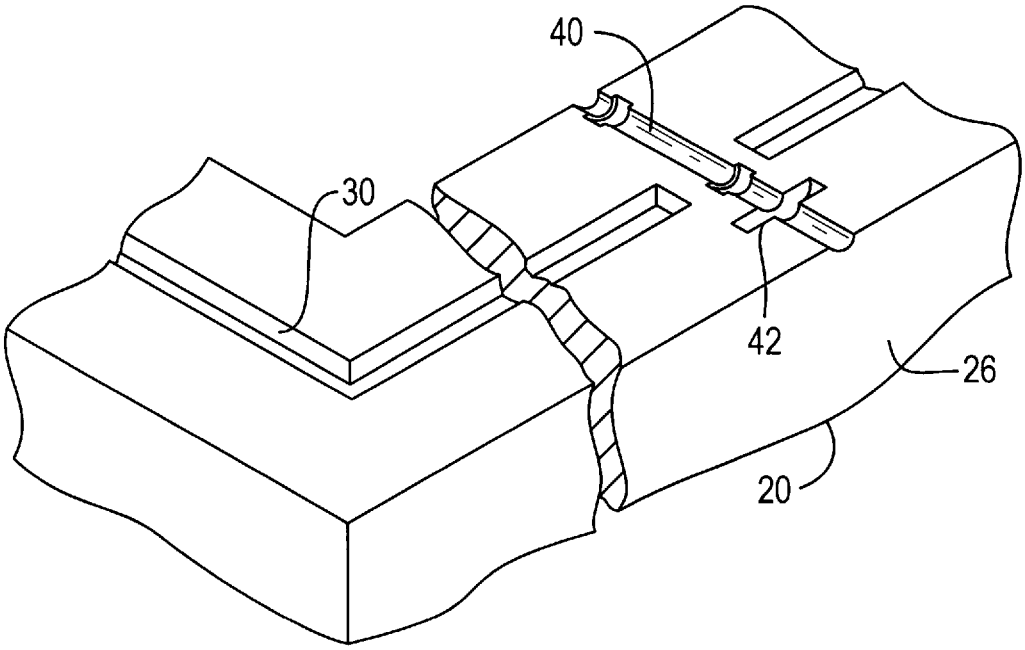
FIG. 5 is a fragmentary perspective view of one section of the containment die showing the recess for the fluid inlet tube therein.

Referring now to FIGS. 4 and 5, the preform configuration 10, with the gas inlet tube in place is placed in a containment die 20, such as a forming tool or other limiting structure. The containment die 20 defines a cavity 22 designed to match the desired final design shape of the hollow airfoil structure. For example, the predetermined shape can have a compound curve and may, for example, define the predetermined shape of a leading edge of an aircraft wing. The size and shape of the resultant structural part are limited by the dimensions of the containment die 20 and raw sheet material used.

The containment die 20 preferably has an upper section 24 and a lower section 26, which are capable of being brought together under force such as, for example, a hydraulic press. The interior surfaces of the upper 24 and lower 26 sections of the containment die 20 may be simple or complex and may be the same or different. The resulting structural component may have any simple or complex geometry that can be formed using superplastic forming in two opposite directions using a single containment die.

The containment die 20 contains a lock bead and seal groove structure, which traverses nearly the entire circumference of the containment die as discussed below. This structure assists in maintaining a gas-tight seal when the containment die 20 is closed. The lock and seal groove structure comprises a lock bead 28 in one section 24 of the containment die 20 and an aligned mating seal groove 30 in the other section 26. Either section of the die may have the bead or the groove. When the containment die 20 with the preform configuration 10 in place is closed, the lock bead 28 extends into and mates with the seal groove 30, thereby sealing the upper face 12 and lower face 14 of the preform configuration 10 together without the need for welding, diffusion bonding, or other adhesion methods. Lock bead 28 and seal groove 30 may have any size and shape so long as when the upper and lower die are closed, a gas tight-seal is formed. Typically, the bead 28 will have a rectangular cross-section approximately 0.004 inches in height and 0.30 inches in width. The bead may also comprise two beads in parallel or be U- or W-shaped.

The containment die 20 may also include tooling pins 23 and corresponding mating slots 25 to assist in aligning the upper 24 and lower 26 sections of the containment die 20 during closure. Preferably, tooling pins 23 are approximately ¼ inches in height and are located in either the upper section 24 or lower section 26 of the containment die 20. The mating slots 25 are located on the corresponding die section and are shaped to receive the tooling pins 23 upon closure of the die.

The containment die should be large enough to hold that portion of the preform configuration 10 that will superplastically deform to form the final structure. Desirably, the preform configuration 10 will be large enough so that the edge portions 16 of the upper and lower faces 12 and 14 extend towards the peripheries of the dies beyond the bead and groove of the seal. Thus, when the containment die 20 is closed (i.e., the upper and lower sections are brought together), the lock bead 28 extends into the seal groove 30 and the edge portions 16 of each face of the preform configuration 10 are trapped in between the lock bead and seal groove, thereby holding the respective edge portions 16 of the preform configuration 10 in a fixed relationship and sealing them together. Thus, the structure will be fluidly closed on all sides (except for the gas inlet tube) and can contain and thus be forced to expand by pressurized gas.

In FIG. 5, the lower section 26 of the containment die 20 has a recess 40 for locating, holding, and restraining the gas inlet tube, which is in fluid communication with the internal portion of the preform configuration. The upper section 24 of the die 20 has a mirror-image recess. Alternatively, the recess 40 may be located in only one section (either the upper section 24 or lower section 26) of the containment die 20. Regardless of where the recess is or the recesses are located, a fluid-tight seal must be formed when the die is closed. The gas inlet tube should be aligned with the recesses 40 of the upper section 24 and lower section 26 of the containment die 20 so that, when the containment die 20 is closed, the internal portion of the preform configuration 10 can be in fluid communication with the source of the pressurized gas to be used during superplastic forming.

Figure 6:
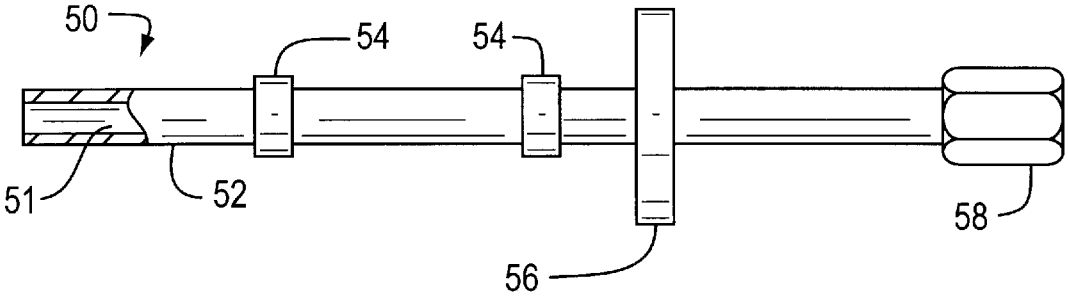
FIG. 6 is an elevational view of one embodiment of the reusable gas inlet tube.

FIG. 6 shows a preferred gas inlet tube 50. Preferably the gas inlet tube 50 is fabricated from a material different from the sheet material, which helps to prevent diffusion bonding of the gas inlet tube 50 to the preform configuration 10 during superplastic forming. Thus, if the sheet material is titanium, tube 50 may be a stainless steel alloy.

The gas inlet tube 50 has an elongated barrel member 52, which is designed to partially extend into the interior of the preform configuration 10. The barrel member 52 includes an internal bore 51 formed along its entire length for conducting the forming gas from the external pressurized gas source (not shown) to the interior of the preform configuration 10. The diameter of the internal bore 51 is sized to permit sufficient gas flow from the external source during the superplastic forming step.

The reusable gas inlet tube 50 includes sealing lands 54 on the barrel 52. As the containment die 20 closes, part of the edge portions 16 of the upper face 12 and part of the edge portion 16 of the lower face 14 of the preform configuration 10 deform around the barrel 52 and sealing lands 54, thereby forming a gas-tight seal between the outside of tube 50 and preform configuration 10. At the same time, a gas-tight seal is formed between the outside of preform configuration 10 and the containment die 20.

The gas inlet tube 50 also includes a locating/restraining ring 56 to help hold the tube 50 in position during the superplastic forming step. After placing the gas inlet tube 50 in the preform configuration 10, placing the preform configuration 10 in the containment die 20, and closing the die, the locating/restraining ring 56 mates with the corresponding recess(es) 40 of the containment die 20 and lies just outside the edge portions 16 of the preform configuration 10 (see FIG. 7). The locating/restraining ring 56 is welded to, or machined into, the barrel 52 and is dimensioned to firmly restrain the gas inlet tube 50 inside the preform configuration 10 during the superplastic forming step.

The gas inlet tube 50 also comprises a connecting fitting 58 attached to the exterior end of the inlet tube 50 to provide a convenient connection to the forming gas source. Preferably, the fitting 58 is welded to the gas inlet tube 50, or less preferably, the fitting 58 may be attached to the rest of the tube by a compression-type fitting, or integrally machined into the gas inlet tube 50.

The gas inlet tube 50 is installed between the upper face 12 and lower face 14 of the preform configuration 10 so that it will be aligned with the recesses 40 of the containment die 20 when preform configuration 10 has been positioned in the die 20. No special preparation of the preform configuration 10 is required for the gas inlet tube 50. Rather, all required features are present in the containment die 20 and the reusable gas inlet tube 50.

As shown in FIG. 5, the recess 40 is shaped to mate with the gas inlet tube 50 and extends from the outside edge of the containment die 40 into the cavity 22. The recess 40 contain channel 42 designed to mate with the restraining ring 56.

Figure 7:
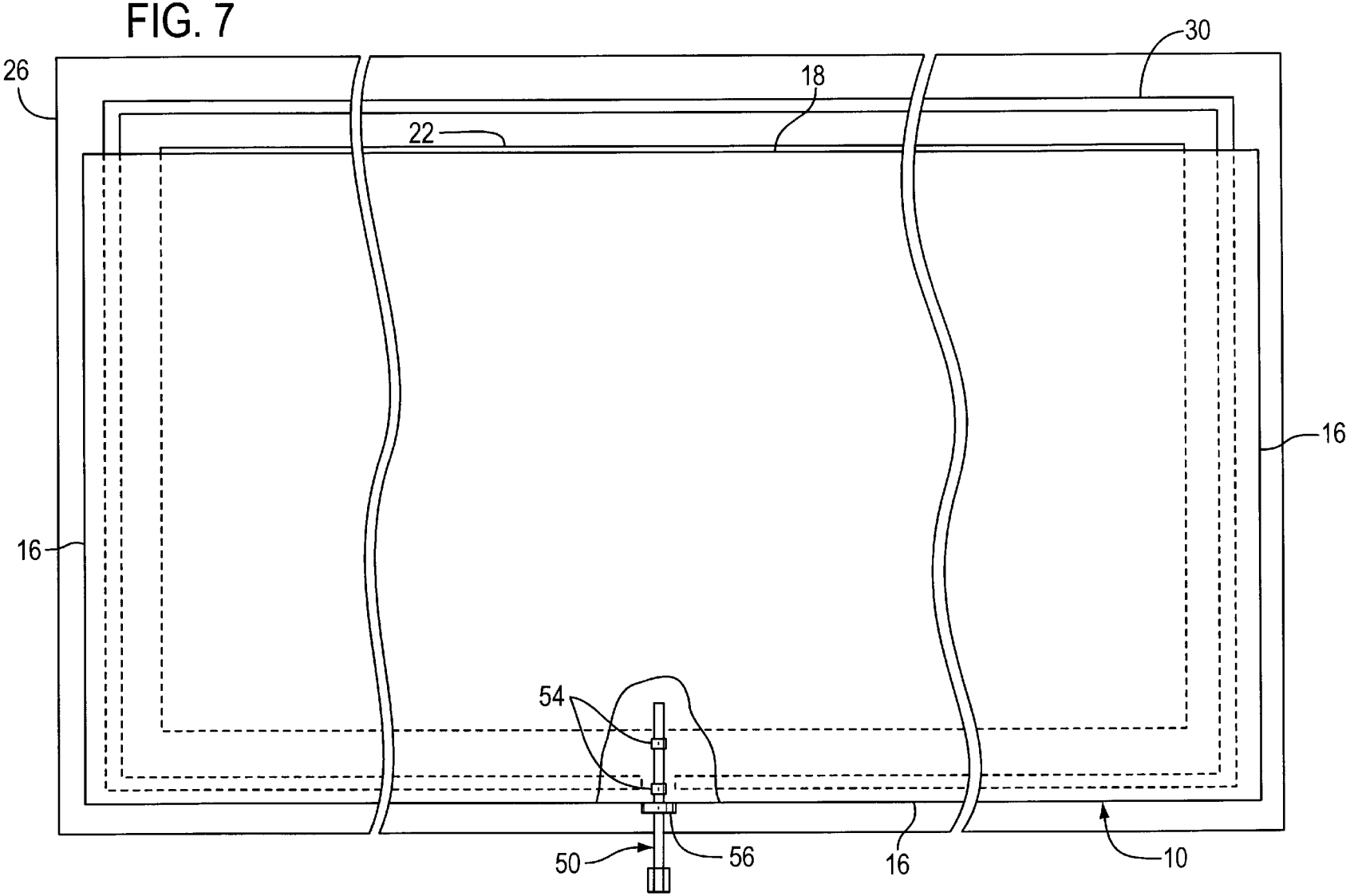
FIG. 7 is a planar view showing the preform configuration (with the gas inlet tube in place) lying on the lower section of the containment die before the die is closed.

The preform configuration 10 with the gas inlet tube 50 installed is placed in lower section 26 of the containment die 20, as illustrated in FIG. 7 (which is not to scale—for example, the size of tube 50 is exaggerated for clarity). The preform configuration 10 is placed in the die 20 so that at least some of the edge portion 16 of the upper and lower faces lie outside the cavity 22 and, preferably, outside bead 28 and groove 30 and the locating/restraining ring 56 lies outside bead 28 and groove 30, but inside the die 20. Ring 56 is preferably positioned so that it lies adjacent the edge of trailing edge portion 16. The regions of the edge portions 16 that lie outside the cavity 22 allow the edge portions 16 to be tightly sealed when the die 20 is closed, as described below.

During closure of the containment die 20 by applying clamping force using, for example, a hydraulic press, the locating/restraining ring 56 mates with the corresponding portion of the recess 40 of the containment die 20 (i.e., channel 42) to locate and hold the gas inlet tube 50 in position. Continued clamping pressure (from, e.g., the hydraulic press) to the upper and lower halves of the containment die 20 causes the sealing lands 54 of tube 50 and the groove 30 and bead 28 to deform the preform configuration 10, thus forming a gas-tight seal between the gas inlet tube 50 and the adjacent edge portions 16 of preform configuration 10 (so that gas flowing through the tube does not leak out around its outside periphery) and a gas-tight seal between the upper and lower faces 12 and 14 of the preform configuration 10 (the three edge portions 16 are deformed and sealed by bead 28 and groove 30), which is now referred to as packet assembly 60. The gas-tight seal between the gas inlet tube 50 and the edge portion 16 of the packet assembly 60 and the gas-tight seal between the upper and lower faces 12 and 14 created by closing the containment die 20 are temporary. After the superplastic forming step, the die 20 is opened, which removes the clamping pressure, thereby unsealing the gas-tight seal between the gas inlet tube 50 and the edge portions 16 of the packet assembly 60 and the gas-tight seal between the upper and lower faces 12 and 14. The ability to form a temporary gas-tight seal eliminates the need to weld or diffusion bond the periphery of the preform configuration 10 or packet assembly 60 prior to the superplastic forming step and eliminates the need to cut off the welded portion from the superplastically formed structure.

After the containment die 20 has been fully closed and the gas-tight seals formed, the packet assembly 60 is ready to be superplastically formed. To do that, a pressure differential is created between the interior and exterior portions of the packet assembly 60 while heating it. The pressure differential is created by injecting fluid, such as a forming gas (e.g., argon, nitrogen, compressed air, or other suitable gasses), through the gas inlet tube 50, thereby increasing the fluid pressure within the internal portion of the packet assembly 60. Concurrently with the establishment of a pressure differential between the interior and exterior portion of the packet assembly 60, the packet assembly 60 is heated to a temperature within the superplastic temperature range of the material. Heating may also commence before creating the pressure differential. As a result, the packet assembly 60 superplastically expands and thereby fills the cavity 22 of the containment die 20. In other words, the packet assembly 60 superplastically deforms to the predetermined shape defined by the cavity 22.

Superplastic forming conditions (time, temperature, pressure, etc.) are known in the art and any suitable superplastic forming conditions may be used in the process of this invention. Generally, the superplastic step is preferably carried out at a temperature in the range of approximately 800° F. (427° C.) to 1800° F. (982° C.). The pressure differential is increased at a rate (ramp rate) of preferably between 0.10 psi (0.6895 kPa) per minute and 100 psi (689.5 kPa) per minute. The pressure is raised to a maximum pressure in the range of 0.1 psi to 100 psi, preferably in the range of about 10 psi to about 100 psi (68.95 to 689.5 kPa). The pressure is maintained until forming is complete. The optimum pressure range and strain rate depend on the material, its thickness, and component configuration.

The time, temperature, and pressure conditions for superplastic forming described above may be varied as long as they are maintained within suitable ranges, i.e., ranges in which the conditions would be sufficient to cause superplastic forming for the one or more sheets of material and die being used.

Figure 8:
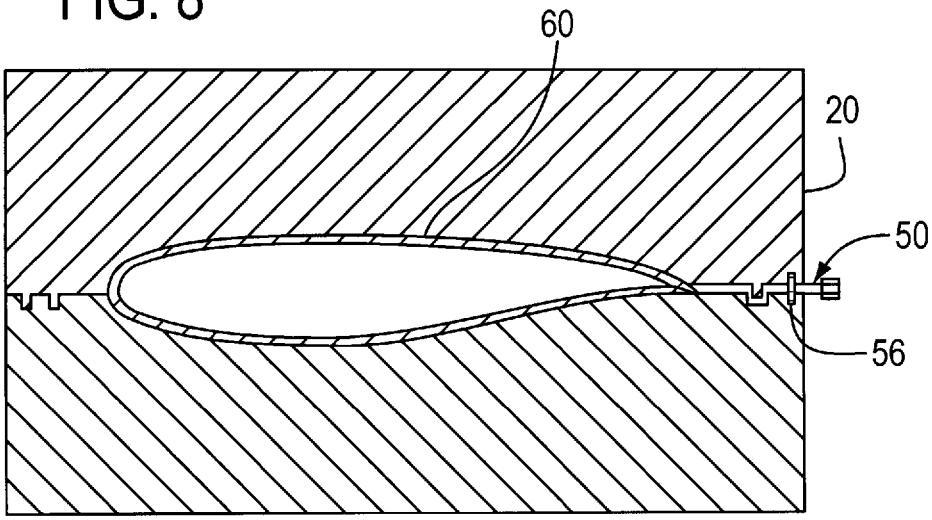
FIG. 8 is a cross-sectional view showing the inflated packet assembly disposed in the containment die after the superplastic forming process.

Once the packet assembly 60 has been superplastically formed (expanded) into the predetermined shape (as shown in FIG. 8), the pressure differential is removed (e.g., the packet assembly pressure is bled), the containment die 20 is opened, the reusable gas inlet tube 50 is removed from the packet assembly 60, and the formed assembly is removed from the die 20. The formed assembly may then be cleaned and machined as appropriate to form the final structure (e.g., an airfoil structure). The gas inlet tube 50 may be reused during the next cycle.

Figure 9:
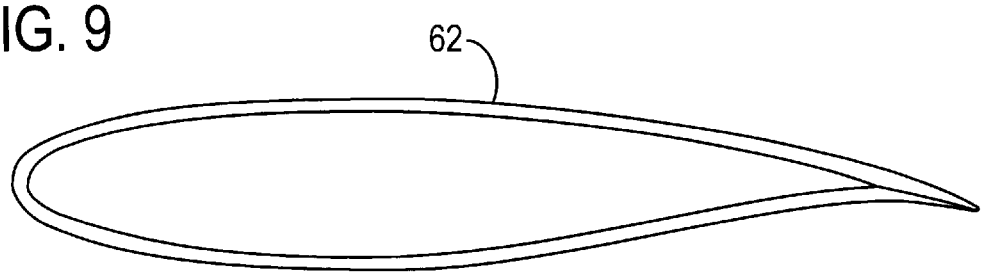
FIG. 9 is a cross-sectional view of a formed hollow airfoil structure after it has been removed from the die.

FIG. 9 shows a structure 62 having a predetermined shape, such as an aircraft wing, which is generally hollow and which has a compound curvature, that has been formed by this process. The structural component (airfoil structure) formed by the process of this invention has, among other things, a relatively smooth exterior surface, which improves its structural integrity and aerodynamic performance.

Figure 12:
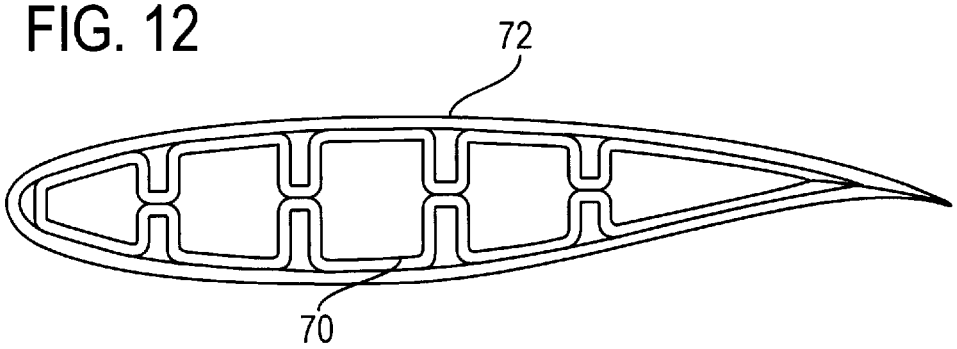
FIG. 12 is a cross-sectional view showing the core structure of FIG. 11 inserted into the skin structure of FIG. 11 after both have been removed from the containment die.

According to another aspect of the present invention, an airfoil structure made by the process of this invention can include, as illustrated in FIG. 12, an internal core assembly 70 for increasing the relative strength of the airfoil structure. The core assembly 70 is located inside of, and, preferably adhered to, a skin assembly 72.

Both the skin assembly 72 and the core assembly 70 can be formed using the method of the present invention. Thus, the skin assembly 72 and the core assembly 70 may each be formed from a single sheet of material, which sheet is separated into two sheets, each of which is then formed into the two preform configurations that are placed into two cavities of the same die or one or two separate dies and superplastically formed.

Figure 10:
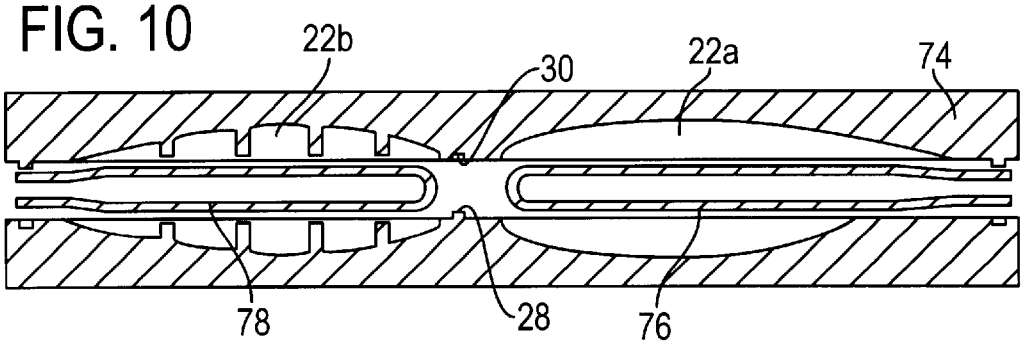
FIG. 10 is a cross-sectional view of another embodiment illustrating both the preform skin configuration and the preform core configuration disposed in different cavities of the same containment die prior to superplasticly forming.

This method of the invention comprises the steps of forming two initial preform configurations, each having an upper and a lower face. Each of these preform configurations is then disposed in a containment die. FIG. 10 shows a containment die 74 in which the superplastic forming step can be carried out. Die 74 has two separate cavities 22*a* and 22*b*, one for the skin preform configuration 76 and one for the core preform configuration 78. With such a dual-cavity die, the two assemblies may be formed simultaneously. Alternatively, two separate dies may be used.

Figure 11:
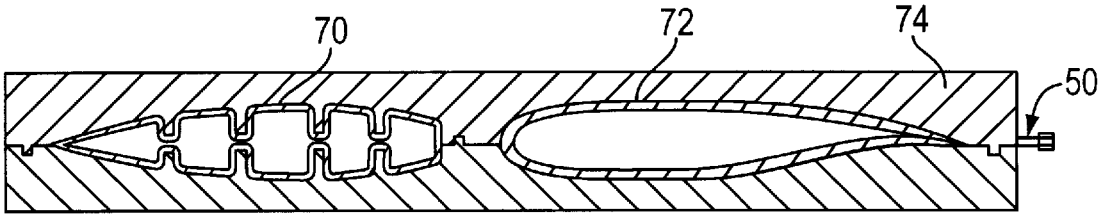
FIG. 11 is a cross-sectional view showing the inflated skin packet assembly and the inflated core assembly disposed in the containment die after superplastic forming.

An inlet tube (preferably reusable), such as that shown in FIG. 6 (or having any other suitable configuration), is inserted between the upper and lower face of each preform configuration to define a port in fluid communication with its interior and the two preform configurations, each with an inlet tube in place, are positioned in the die as shown in FIG. 10. Force is applied to the containment die 74 to sandwich the reusable inlet tubes between the respective upper and lower faces of the preform configurations to form a skin packet assembly 72 and a core packet assembly 70. Pressure differentials (between inside and outside) are applied to the packet assemblies under superplastic forming conditions so that the skin packet assembly 72 and the core packet assembly 70 superplastically expand to fill the cavities, as shown in FIG. 11. Once the packet assemblies have been sufficiently superplastically expanded, the pressure is released, the containment die 74 is opened, the reusable gas inlet tubes are removed and saved for use during the next manufacturing cycle, and the expanded structures are removed from the containment die and finished by trimming off the excess material. The final airfoil structure is formed by inserting the core assembly 70 into the skin assembly 72, as illustrated in FIG. 12. The internal core assembly may then be joined to the outer skin assembly using conventional techniques, such as welding, adhesive bonding, or mechanical fastening.

This aspect of the present invention provides the ability to simultaneously create the two major parts of an airfoil structure. Simultaneously production reduces overall production time. Putting an internal core within the skin produces a stronger and stiffer final structure.

Although the present invention has been described in considerable detail with reference to certain preferred versions thereof, other versions are possible without departing from the spirit and scope of the present invention. Therefore the spirit and scope of the appended claims should not be limited to the description of the preferred embodiments described herein. For example, the process of this invention may be used to form structures for use outside the aeronautical field, e.g., structures for use in boats, automobiles, buildings, furniture, railroad cars, hospital equipment, architectural panels, or any other application requiring a closed metal shape.

What is claimed is:

1. A method for forming a hollow structure having a continuous first edge and a predetermined shape from a sheet capable of being formed under superplastic conditions into the predetermined shape, said method comprising the steps of:

(a) forming the sheet into a preform configuration having a continuous first edge, an upper face, and a lower face, said upper and lower faces each having an open edge portion;

(b) disposing the preform configuration in a containment die comprising a first section and a second section that together define a first cavity having substantially the predetermined shape;

(c) applying closing force to the two sections of the containment die to force the two die sections together to trap the edge portions of the preform configuration therebetween and hold the edge portions tightly against each other to temporarily seal those edge portions together to make the preform configuration substantially gas-tight, which substantially gas-tight preform configuration constitutes a packet assembly having an inside and an outside; and (d) increasing the pressure inside the packet assembly with respect to the pressure outside the packet assembly under superplastic forming conditions so that at least some portion of the packet assembly superplastically expands to conform to the first cavity of the containment die and thereby forms a hollow structure having the predetermined shape.

2. The method of claim 1 wherein step (d) comprises introducing pressurized gas inside the packet assembly.

3. The method of claim 2 wherein the gas is selected from the group consisting of argon, nitrogen, and compressed air.

4. The method of claim 1 further comprising positioning a fluid inlet tube between the upper and lower faces of the preform configuration so that after step (c) there is a fluid inlet port in fluid communication with the inside of the packet assembly.

5. The method of claim 4 wherein step (d) comprises introducing pressurized gas inside the packet assembly through the fluid inlet tube.

6. The method of claim 4 wherein at least one section of the containment die further comprises a recess to accept and retain the fluid inlet tube.

7. The method of claim 6 wherein the fluid inlet tube comprises a restraining ring that corresponds to and mates with the recess in the at least one section of the containment die as the two die sections are being forced together to help maintain the gas inlet tube in proper position.

8. The method of claim 6 wherein the fluid inlet tube further comprises sealing lands to deform part of the preform configuration as the two die sections are being forced together to help form a gas-tight seal around the periphery of the fluid inlet tube.

9. The method of claim 1 wherein step (d) includes heating the packet assembly.

10. The method of claim 1 wherein step (d) includes maintaining the packet assembly at a temperature of from 815° C. to 982° C.

11. The method of claim 1 wherein step (d) comprises increasing the pressure inside the packet assembly at a rate of from 0.10 psi to 100 psi per minute to a maximum pressure in the range of from 10 to 100 psi.

12. The method of claim 1 wherein step (a) comprises roll forming the sheet.

13. The method of claim 1 wherein step (a) comprises brake forming the sheet.

14. The method of claim 1 wherein the containment die comprises sealing means for helping maintain a gas-tight seal in the preform configuration as the closing force is being applied.

15. The method of claim 14 wherein the sealing means comprises a bead on one die section and a corresponding mating groove in the other die section.

16. The method of claim 15 wherein the bead and groove deform the edge portions of the preform configuration as the closing force is applied to the two sections of the containment die, thereby to help make the preform configuration substantially gas-tight.

17. The method of claim 1 further comprising opening the die by moving the two die sections apart and removing the formed hollow structure having the predetermined shape, which structure has attached to it the two edge portions that have not been superplastically expanded into the first cavity.

18. The method of claim 17 further comprising the step of removing at least some of the two edge portions from the formed hollow structure.

19. The method of claim 1 wherein the containment die further comprises a second cavity having substantially a second predetermined shape, the method further comprising disposing a second preform configuration in the containment die proximate the second cavity, said second preform configuration having a continuous first edge, an upper face, and a lower face, said upper and lower faces each having an open edge portion.

20. The method of claim 19 wherein the step of applying closing force to the two sections of the containment die to force the two die sections together traps the edge portions of the second preform configuration therebetween and holds those edge portions tightly against each other to temporarily seal those edge portions together to make the second preform configuration substantially gas-tight, which substantially gas-tight second preform configuration constitutes a second packet assembly having an inside and an outside.

21. The method of claim 20 wherein the step of increasing the pressure inside the packet assembly simultaneously increases the pressure inside the second packet assembly with respect to the pressure outside the second packet assembly under superplastic forming conditions so that at least some portion of the second packet assembly superplastically expands to conform to the second cavity of the containment die and thereby forms a core structure having the second predetermined shape.

22. The method of claim 21 further comprising inserting the core structure into the hollow structure and joining the core structure to the hollow structure.

23. The method of claim 1 wherein the hollow structure is an airfoil.

24. A method for forming a hollow structure having a continuous first edge and a predetermined shape from a sheet capable of being formed under superplastic forming conditions into the predetermined shape, said method comprising the steps of:

(a) forming the sheet into a preform configuration having a continuous first edge, an upper face, and a lower face, said upper and lower faces each having an open edge portion;

(b) positioning a fluid inlet tube between the upper and lower faces of the preform configuration;

(c) disposing the preform configuration in a containment die comprising a first section and a second section that together define a cavity having substantially the predetermined shape;

(d) applying closing force to the two sections of the containment die to force the two die sections together (i) to trap the edge portions of the preform configuration therebetween and hold the edge portions tightly against each other to temporarily seal those edge portions together to make the preform configuration substantially gas-tight, which substantially gas-tight preform configuration constitutes a packet assembly having an inside and an outside, and (ii) to deform part of the preform configuration as the two die sections are being forced together to form a gas-tight seal around the periphery of the fluid inlet tube, which fluid inlet tube provides a fluid inlet port in fluid communication with the inside of the packet assembly; and (e) introducing pressurized gas inside the packet assembly through the fluid inlet tube to increase the pressure inside the packet assembly with respect to the pressure outside the packet assembly under superplastic forming conditions so that at least some portion of the packet assembly superplastically expands to conform to the cavity of the containment die and thereby forms a hollow structure having the predetermined shape.

25. The method of claim 24 wherein at least one section of the containment die further comprises a recess to accept and retain the fluid inlet tube.

26. The method of claim 25 wherein the fluid inlet tube comprises a restraining ring that corresponds to and mates with the recess in the at least one section of the containment die as the two die sections are being forced together to help maintain the gas inlet tube in proper position.

27. The method of claim 26 wherein the containment die comprises sealing means for helping maintain a gas-tight seal in the preform configuration as the closing force is being applied.

28. The method of claim 27 wherein the sealing means comprises a bead on one die section and a corresponding mating groove in the other die section.

29. The method of claim 28 wherein the bead and groove deform the edge portions of the preform configuration as the closing force is applied to the two sections of the containment die, thereby to help make the preform configuration substantially gas-tight.

30. The method of claim 24 further comprising opening the die by moving the two die sections apart and removing the formed hollow structure having the predetermined shape, which structure has attached to it the two edge portions that have not been superplastically expanded into the die cavity.

31. The method of claim 30 further comprising the step of removing at least some of the two edge portions from the formed hollow structure.

32. The method of claim 24 wherein the hollow structure is an airfoil.

33. A method for forming a hollow structure having a continuous first edge and a predetermined shape from a sheet capable of being formed under superplastic forming conditions into the predetermined shape, said method comprising the steps of:

(a) forming the sheet into a preform configuration having a continuous first edge, an upper face, and a lower face, said upper and lower faces each having an open edge portion;

(b) disposing the preform configuration in a containment die comprising a first section and a second section that together define a cavity having substantially the predetermined shape;

(c) positioning a fluid inlet tube between the upper and lower faces of the preform configuration;

(d) applying closing force to the two sections of the containment die to force the two die sections together (i) to trap the edge portions of the preform configuration therebetween and hold the edge portions tightly against each other to temporarily seal those edge portions together to make the preform configuration substantially gas-tight, which substantially gas-tight preform configuration constitutes a packet assembly having an inside and an outside, and (ii) to deform part of the preform configuration as the two die sections are being forced together to form a gas-tight seal around the periphery of the fluid inlet tube, which fluid inlet tube provides a fluid inlet port in fluid communication with the inside of the packet assembly; and (e) introducing pressurized gas inside the packet assembly through the fluid inlet tube to increase the pressure inside the packet assembly with respect to the pressure outside the packet assembly under superplastic forming conditions so that at least some portion of the packet assembly superplastically expands to conform to the cavity of the containment die and thereby forms a hollow structure having the predetermined shape.

34. A method for forming a hollow structure having a continuous first edge and a predetermined shape from a preform configuration having a continuous first edge, an upper face, and a lower face, said upper and lower faces each having an open edge portion, the preform configuration being of a material capable of being formed under superplastic forming conditions into the predetermined shape, said method comprising the steps of:

(a) disposing the preform configuration in a containment die comprising a first section and a second section that together define a cavity having substantially the predetermined shape;

(b) applying closing force to the two sections of the containment die to force the two die sections together to trap the edge portions of the preform configuration therebetween and hold the edge portions tightly against each other to temporarily seal those edge portions together to make the preform configuration substantially gas-tight, which substantially gas-tight preform configuration constitutes a packet assembly having an inside and an outside; and (c) increasing the pressure inside the packet assembly with respect to the pressure outside the packet assembly under superplastic forming conditions so that at least some portion of the packet assembly superplastically expands to conform to the cavity of the containment die and thereby forms a hollow structure having the predetermined shape.

35. The method of claim 34 wherein step (c) comprises introducing pressurized gas inside the packet assembly.

36. The method of claim 34 further comprising positioning a fluid inlet tube between the upper and lower faces of the preform configuration so that before step (c) there is a fluid inlet port in fluid communication with the inside of the packet assembly.

37. The method of claim 34 wherein the containment die comprises a bead on one die section and a corresponding mating groove in the other die section for helping maintain a gas-tight seal in the preform configuration as the closing force is being applied, the bead and groove deforming the edge portions of the preform configuration as the closing force is applied, thereby to help make the preform configuration substantially gas-tight.

38. A method for forming a hollow structure having a continuous first edge and a predetermined shape from a preform configuration having a continuous first edge, an upper face, and a lower face, said upper and lower faces each having an open edge portion, the preform configuration being of a material capable of being formed under superplastic forming conditions into the predetermined shape, said method comprising the steps of:

(a) positioning a fluid inlet tube between the upper and lower faces of the preform configuration;

(b) disposing the preform configuration in a containment die comprising a first section and a second section that together define a cavity having substantially the predetermined shape;

(c) applying closing force to the two sections of the containment die to force the two die sections together (i) to trap the edge portions of the preform configuration therebetween and hold the edge portions tightly against each other to temporarily seal those edge portions together to make the preform configuration substantially gas-tight, which substantially gas-tight preform configuration constitutes a packet assembly having an inside and an outside, and (ii) to deform part of the preform configuration as the two die sections are being forced together to form a gas-tight seal around the periphery of the fluid inlet tube, which fluid inlet tube provides a fluid inlet port in fluid communication with the inside of the packet assembly; and (d) introducing pressurized gas inside the packet assembly through the fluid inlet tube to increase the pressure inside the packet assembly with respect to the pressure outside the packet assembly under superplastic forming conditions so that at least some portion of the packet assembly superplastically expands to conform to the cavity of the containment die and thereby forms a hollow structure having the predetermined shape.

* * * * *